United States Patent [19]

Terada et al.

[11] Patent Number: 5,007,144

[45] Date of Patent: Apr. 16, 1991

[54] SLIDE FASTENER SLIDER

[75] Inventors: Yasuharu Terada, Uozu; Susumu Ishii, Kurobe, both of Japan

[73] Assignee: Yoshida Kogyo K. K., Tokyo, Japan

[21] Appl. No.: 502,733

[22] Filed: Apr. 2, 1990

[30] Foreign Application Priority Data

Mar. 31, 1989 [JP] Japan ..... 1-38538
Apr. 17, 1989 [JP] Japan ..... 1-44771

[51] Int. Cl.[5] ..... A44B 19/26
[52] U.S. Cl. ..... 24/415; 24/431
[58] Field of Search ..... 24/415, 405, 417, 431, 24/432

[56] References Cited

U.S. PATENT DOCUMENTS

| | | | |
|---|---|---|---|
| 2,221,759 | 11/1940 | Erard | 24/431 |
| 2,295,976 | 9/1942 | Suskowitz et al. . | |
| 2,458,914 | 1/1949 | Morin | 24/415 |
| 2,840,877 | 7/1958 | Foltis . | |
| 2,879,573 | 3/1959 | Ulrich | 24/415 |
| 2,911,699 | 11/1959 | Koehler . | |
| 4,048,699 | 9/1977 | Kanzaka | 24/415 |
| 4,268,939 | 5/1981 | Fukuroi | 24/415 |

FOREIGN PATENT DOCUMENTS

| | | | |
|---|---|---|---|
| 1920708 | 1/1971 | Fed. Rep. of Germany . | |
| 1039704 | 9/1953 | France . | |
| 1531615 | 7/1968 | France | 24/431 |
| 48-30003 | 4/1973 | Japan . | |
| 0387480 | 2/1933 | United Kingdom | 24/415 |
| 612995 | 11/1948 | United Kingdom . | |
| 2026598 | 2/1980 | United Kingdom . | |

*Primary Examiner*—Victor N. Sakran
*Attorney, Agent, or Firm*—Hill, Van Santen, Steadman & Simpson

[57] ABSTRACT

A slide fastener slider comprises upper and lower wings joined together at their one ends by a connecting neck and having respective lateral flanges, and a thermal insulating backing such as of plastics material substantially coextensive with the lower wing. The backing is secured to the lower wing by injection-molding, rivetting, or snapping engagement of hooks on the backing with recesses in the lower wing. Additionally, there is provided for the purpose of heat insulation an air accommodating pocket formed between the backing and the lower wing.

7 Claims, 8 Drawing Sheets

SLIDE FASTENER SLIDER

BACKGROUND OF THE INVENTION

1. Field of the Invention

This invention relates generally to slide fasteners and particularly to a slider therefor.

2. Prior Art

There have been heretofore proposed numerous slide fastener sliders of various forms and designs. However, to the best knowledge of the present inventors, there are known no such sliders which are suitable for use in extremely cold environment where a slider, if made of a metal, tends to give unpleasant chilling feel and at worse a frostbite to the skin of the user.

One prior art is known as disclosed in Japanese Laid-Open Utility Model Publication No. 48-30003, in which a metallic slider is covered with a soft material such as plastics at its surface portions located internally of a camera case so as to eliminate possible damage to the camera.

Such prior device is however not capable of application onto garment articles such as ski wear, wind jackets, shirts and the like which would come into direct contact with the human skin particularly in extremely cold weather. The plastic cover used in the prior device is simply mounted on the underside of a slider and hence is liable to separation if used on such garments which need laundering and press.

SUMMARY OF THE INVENTION

Whereas, it is a primary object of the present invention to provide a slide fastener slider which incorporates a thermally insulating means whereby the user can be protected against adverse effect of extremely cold weather upon his skin which would otherwise result in freezing touch or frostbite by bare metal portions of the slider.

This and other objects and features of the invention will appear apparent from the following description taken in conjunction with the accompanying drawings.

According to the invention, there is provided a slide fastener slider comprising a slider body including an upper wing and a lower wing joined together at their one ends by a connecting neck and having respective inwardly directed lateral flanges, the lower wing having an anchoring ridge on its outer surface, and a thermal insulating backing coextensive with and secured to the lower wing.

DETAILED DESCRIPTION OF THE INVENTION

Figure 1:
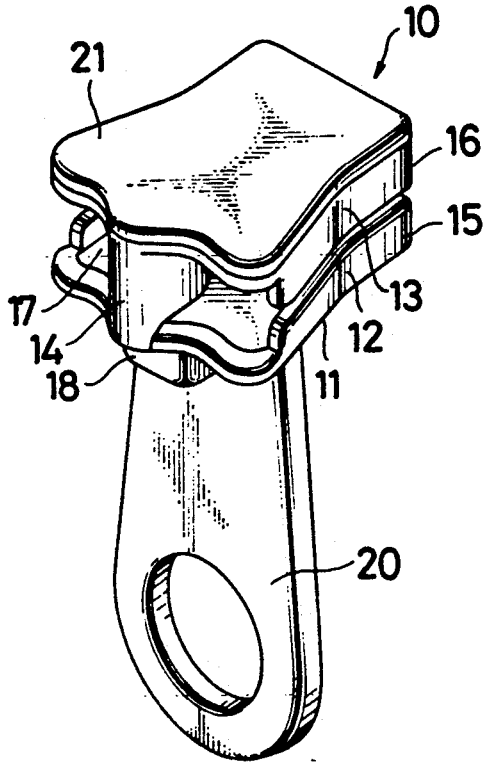
FIG. 1 is an elevational perspective view of a slide fastener slider embodying the invention.

Referring now to the drawings and FIG. 1 in particular, there is shown a slider 10 to be mounted on and adapted to open and close a slide fastener (not shown) in a manner well known in the art. The slider 10 is formed by molding a metal such as a zinc alloy into a predetermined shape and has a slider body 11 which includes an upper wing 12 and a lower wing 13 which are spaced in parallel relation and joined at their one or front ends by a connecting neck 14 commonly known as a diamond. The upper and lower wings 12, 13 are generally similar in shape and inwardly directed along their respective lateral side edges to form lateral flanges 15 and 16.

The upper and lower wings 12 and 13 define therebetween a generally Y-shaped guide channel 17 for passing therethrough a pair of fastener stringers (not shown) in a manner well known in the art.

Formed on the upper surface of the upper wing 12 is a trunnion 18 having an opening 19 for pivotally receiving a pull tab 20 with which to manipulate a reciprocating movement of the slider 10 on the slide fastener in a manner well known in the art.

According to the invention, there is provided a thermal insulating backing 21 made of a synthetic resin such as for example PBT and polyamide (nylon 66) which are preferably reinforced with glass fiber, semi-hardness urethane foams, polyelthylene and the like. The resinous backing 21 is conveniently mounted on the slider body 11 as by injection molding. The backing 21 may be, if desired, provided on its outer surface 21*a* with a metal foil carrying colored indicia such as marks, letters, designs and the like thereby affording an ornamental effect.

The backing 21 shown in FIGS. 1–4 is coextensive with and hence substantially a replica of a lower or outer surface 22 of the lower wing 13 of the slider body 11 as observed in plan view.

Figure 2:
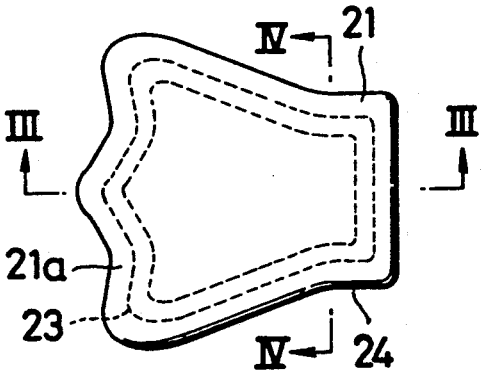
FIG. 2 is a plant view of a thermal insulating backing secured to an outer surface of a lower wing member of the slider of FIG. 1, the lower wing having an anchoring ridge (dotted line)
Figure 3:
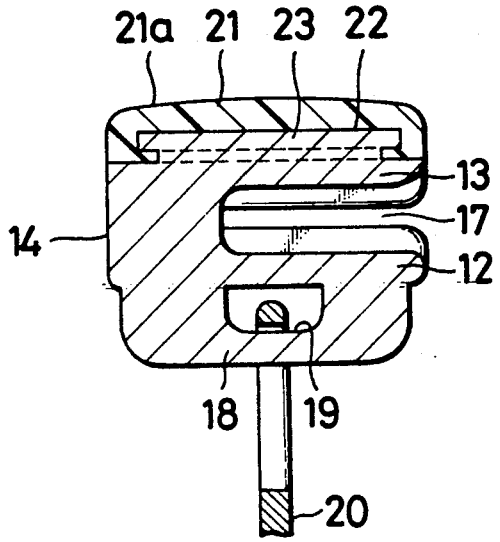
FIG. 3 is a longitudinal cross-sectional view taken on the line III—III of FIG. 2.
Figure 4:
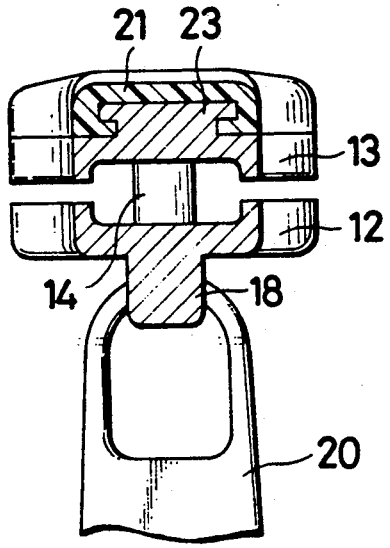
FIG. 4 is a transverse cross-sectional view taken on the line IV—IV of FIG. 2.

The lower wing 13 has a continuous peripheral anchoring ridge 23 extending from its outer surface 22 internally of and in conformity with a peripheral contour 24 of the lower wing 13, as shown in FIG. 2. The continuous peripheral ridge 23 has a substantially T-shaped transverse cross section, as shown in FIG. 4, which contributes to firm fixation of the backing 21 to the slider body 11 against displacement relative to or separation from the lower wing 13 after the backing 21 has been injection-molded thereon.

Figure 5:
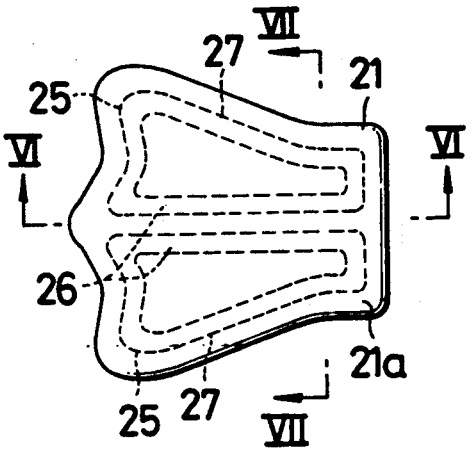
FIG. 5 is a view similar to FIG. 2 but showing another form of anchoring ridge (dotted line) on the lower wing.
Figure 6:
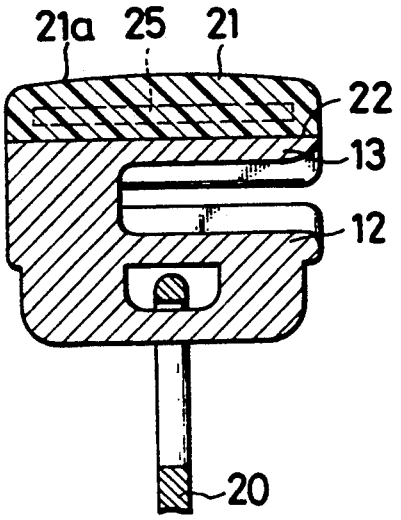
FIG. 6 is a longitudinal cross-sectional view taken on the line VI—VI of FIG. 5.
Figure 7:
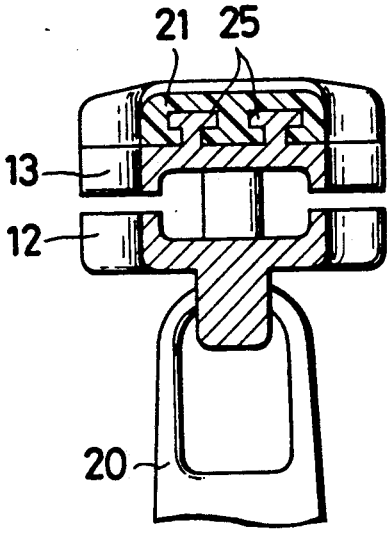
FIG. 7 is a transverse cross-sectional view taken on the line VII—VII of FIG. 5.

FIGS. 5–7, inclusive, show the backing 21 molded on the lower wing 13 which has on its outer surface 22 a pair of identical continuous anchoring ridges 25, 25 consisting of spaced parallel straight portions 26, 26 extending longitudinally centrally of the slider body 11 and peripheral portions 27, 27 extending in conformity with the peripheral contour 24 of the backing 21. Each of the anchoring ridges 25, 25 has a substantially T-shaped transverse cross section as shown in FIG. 7 for the purpose already described.

Figure 8:
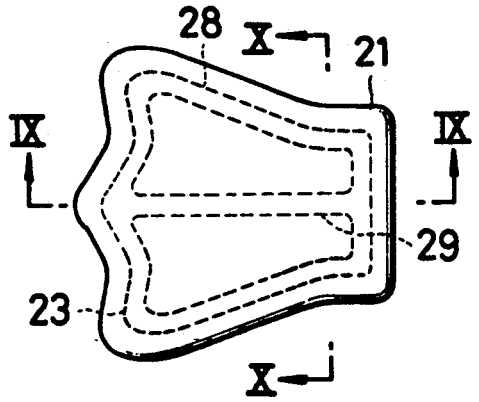
FIG. 8 is a view similar to FIG. 2 but showing still another form of anchoring ridge (dotted line) on the lower wing.
Figure 9:
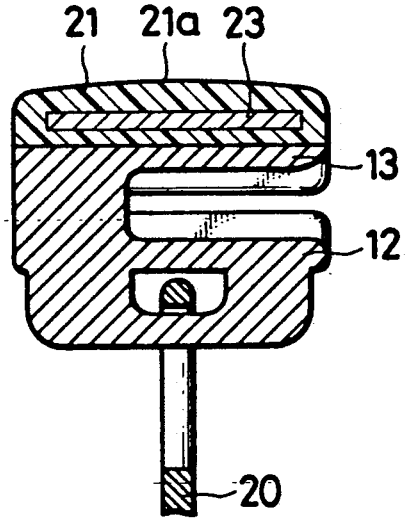
FIG. 9 is a longitudinal cross-sectional view taken on the line IX—IX of FIG. 8.
Figure 10:
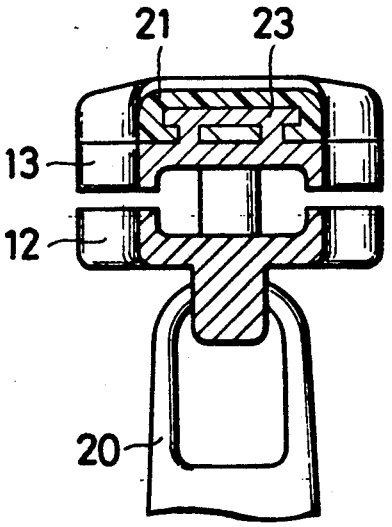
FIG. 10 is a transverse cross-sectional view taken on the line X—X FIG. 8.

FIGS. 8–10, inclusive, show the backing 21 molded onto the lower wing 13 which has on its outer surface 22 a continuous anchoring ridge 28 which is similar in plan geometry to that of FIGS. 1–4, only except that the ridge 28 is subdivided into identical halves by a straight border portion 29 extending longitudinally centrally of the slider body as shown in FIG. 8 and has a transverse cross section as shown in FIG. 10 for the purpose of providing enhanced stability in the fixation of the backing 21 to the lower wing 13.

Figure 11:
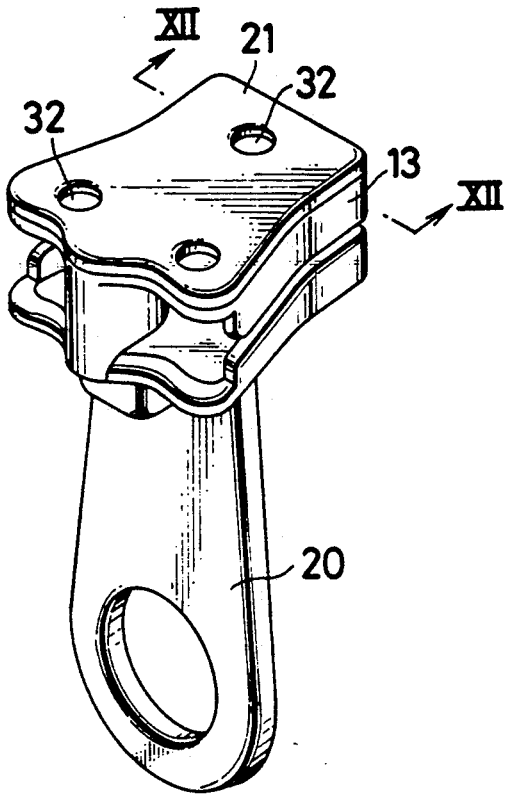
FIG. 11 is an elevational perspective view of a slide fastener slider according to another embodiment of the invention.
Figure 12:
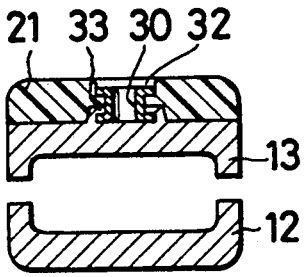
FIG. 12 is a transverse cross-sectional view taken on the line XII—XII of FIG. 11.
Figure 13:
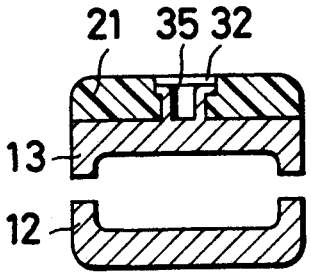
FIG. 13 is a view similar to FIG. 12 but showing a different securing the backing to the lower wing.

An alternative method of mounting a thermal insulating backing 21 on the lower wing 13 of the slider 10 is shown in FIGS. 11–13, wherein the backing 21 is formed of a fabric, a leather, natural or artificial, or a plastics material.

The backing 21 is secured by a plurality of rivets 30 applied at suitable intervals along peripheral portions 31 of the backing. In the case of FIG. 12, rivets 30 preferably of brass are applied externally through openings 32 in the backing 21 and clamped in place with claws 33 formed on the outer surface 22 of the lower wing 13, in which instance the rivets 30 are disposed with their heads 34 sunk below the level of the outer surface 22 of the lower wing 13.

FIG. 13 shows a rivet-like projection 35 extending integrally from the lower wing 13 and a plurality of such projections 35 are distributed along the peripheral portions 31 of the lower wing 13 for securing the backing 21 in place against displacement or detachment.

Figure 14:
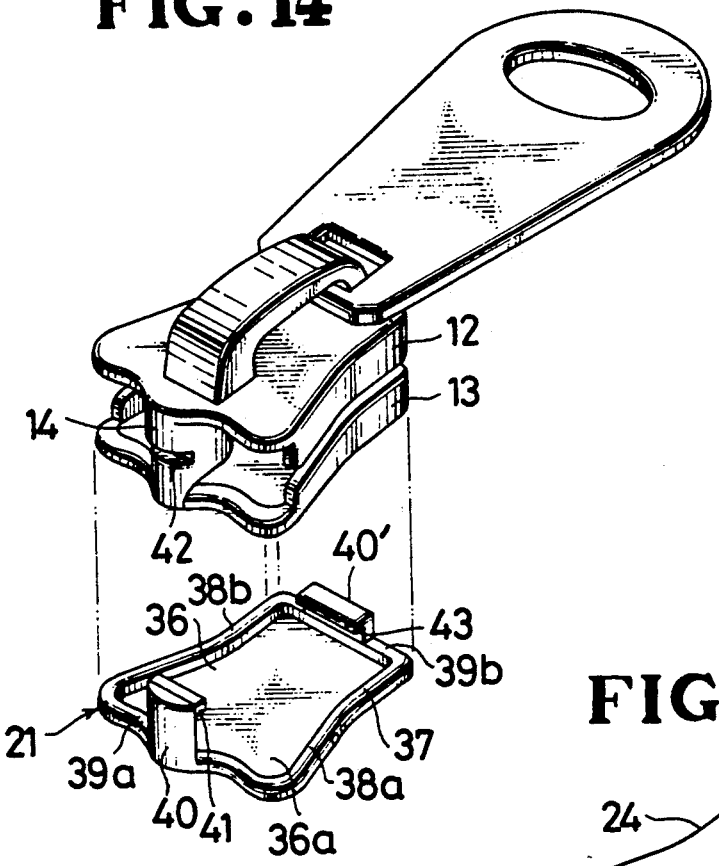
FIG. 14 is a partly exploded, perspective view of a slide fastener s according to a further embodiment of the invention.
Figure 15:
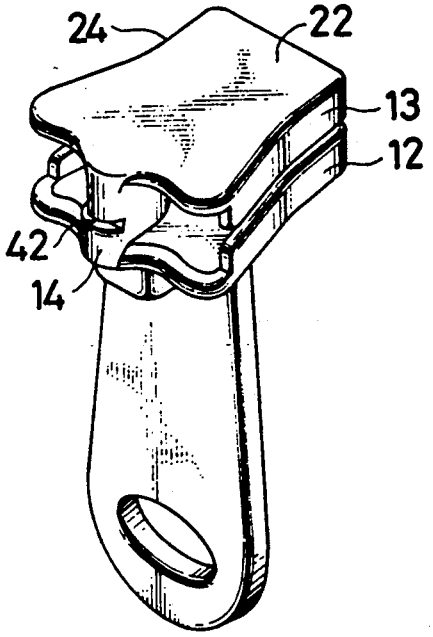
FIG. 15 is an elevational perspective view of the same but showing down without a backing.

A thermal insulating backing 21 shown in FIG. 14 is in the form of a snap-fit cover structure having a generally square web 36 surrounded by a continuous inwardly directed peripheral flange 37 including opposed longitudinal side portions **38*a* and 38*b* and opposed front and rear end portions 39*a*, 39*b*. The flange 37 registers peripherally with the lower wing 13 of the slider 10. A clamping lug 40 extends vertically centrally from the front end portion 39*a* of the flange 37 and has a horizontally inwardly directed hook 41 engageable in a recess 42 formed in the neck 14 of the slider 10. An elongate clamping jaw 40' protrudes inwardly from the rear end portion 39*b* of the flange 37 and has a horizontally inwardly directed hook 43 engageable in a recess 44 formed in a rear end of the lower wing 13 of the slider 10**.

Figure 16:
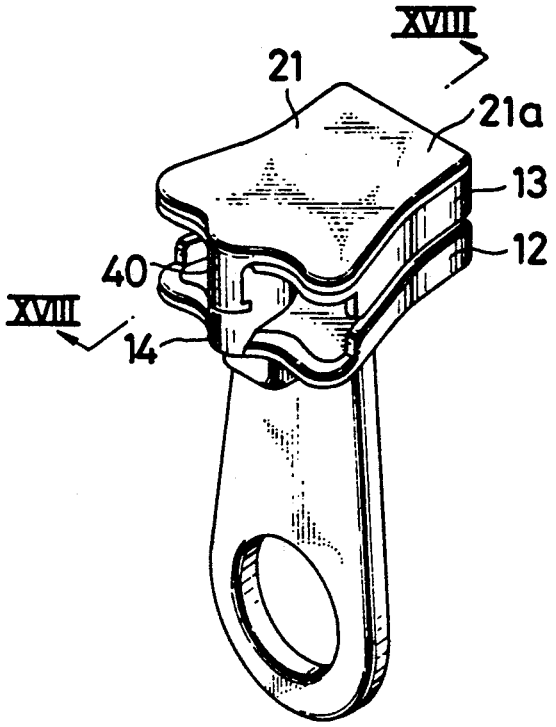
FIG. 16 is a view similar to FIG. 15 but showing a backing attached coextensively to an outer surface of a slider body.
Figure 18:
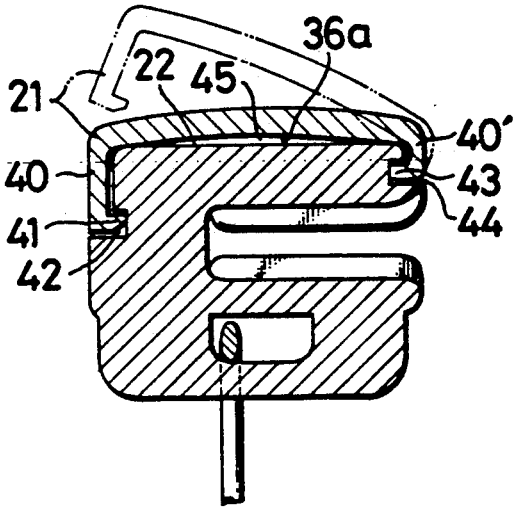
FIG. 18 a longitudinal cross-sectional view taken on the line XVIII—XVIII of FIG. 16.

The backing 21 shown in FIG. 14 or FIG. 16 is mounted snappingly in place on the lower wing 13 of the slider 10 with the hooks 41 and 43 received in the recesses 42 and 44, respectively, in which instance there is developed a pocket 45 in the form of a convex lens, as viewed in FIG. 18, between the outer surface 22 of the lower wing 13 and an inner surface **36*a* of the web 36 of the backing 21. The pocket 45 accommodates an air which serves as a heat insulator to preclude direct transmission to the human skin of cold temperature of the metal slider body 11**.

Figure 17:
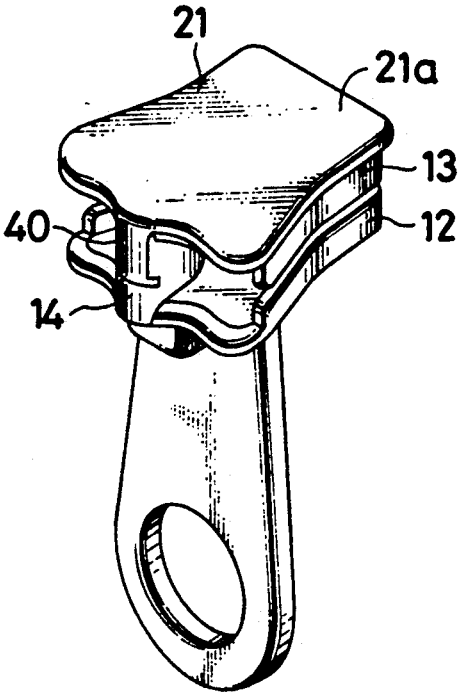
FIG. 17 is a view similar to FIG. 16 but showing the backing protruding beyond a peripheral edge of the lower wing.

A backing 21 shown in FIG. 17 is identical with that shown in FIGS. 14 and 16, except that the side portions **38*a* and 38*b* of the flange 37 respectively protrude slightly beyond and embrace the lateral flanges 16 of the lower wing 13**.

Figure 19:
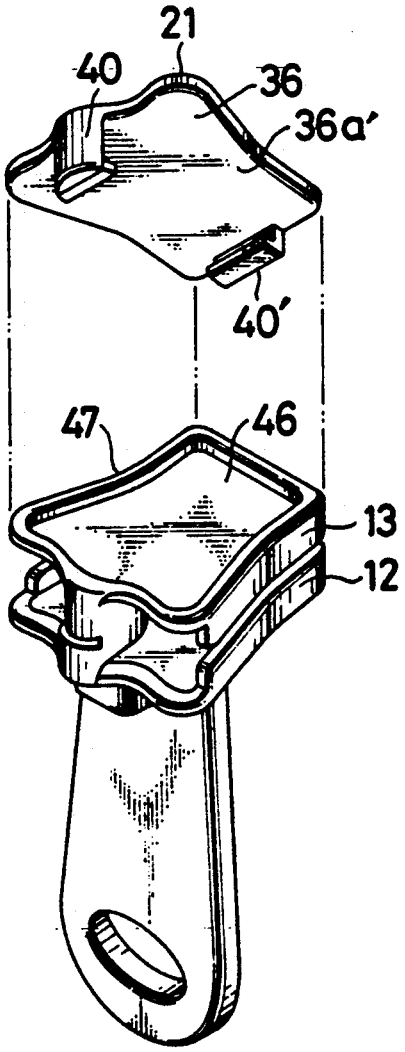
FIG. 19 is a partly exploded, perspective view of a slide fastener slider according to a further embodiment of the invention.
Figure 20:
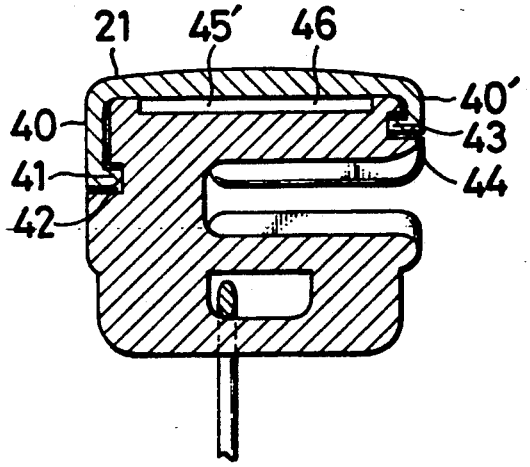
FIG. 20 is a longitudinal cross-sectional view of the slider of FIG. 19 taken on the same reference line as in FIG. 18.

FIGS. 19 and 20 show a backing 21 which is similar to that shown in FIGS. 14 and 16 except that it has a flat inner web surface **36*a'* and is devoid of the peripheral flange 37. The backing 21 of FIGS. 19 and 20 is mounted on the lower wing 13 of the slider in the manner already described and as shown in FIG. 20, in which instance an air accommodating pocket 45' substantially rectangular as viewed in FIG. 20 is formed between the inner surface 36*a'* of the backing 21 and a large square recess 46 formed in the outer surface 22 of the lower wing 13 and defined by a continuous peripheral rib 47**.

Obviously, various modifications and variations of the present invention are possible in the light of the above teaching. It is therefore to be understood that within the scope of the appended claims the invention may be practiced otherwise than as specifically described.

As for an example, the manner of relative engagement between the backing 21 and the lower wing 13 in the embodiments shown in FIGS. 14–20 may be altered such that the hooks 41 and 43 in the former and the recesses 42 and 44 in the latter are interchanged with similar results.

What is claimed is:

1. A slide fastener comprising a slider body including an upper wing and a lower wing jointed together at their one ends by a connecting neck and having respective inwardly directed lateral flanges, said lower wing having an anchoring ridge on its outer surface, and a thermal insulating backing coextensive with and secured to said lower wing and wherein said anchoring ridge extends continuously internally of and in conformity with a peripheral contour of said lower wing.

2. A slide fastener slider according to claim 1 wherein said anchoring ridge consists of a pair of identical halves.

3. A slide fastener according to claim 1 or claim 2 wherein said backing is secured by injection-molding onto said lower wing.

4. A slid fastener slider according to any of the preceding claims wherein said anchoring ridge has a substantially T-shaped transverse cross section.

5. A slide fastener slider comprising a slider body including an upper wing and a lower wing jointed together at their one ends by a connecting neck and having respective inwardly directed lateral flanges, and a thermal insulating backing coextensive with said lower wing, said backing being secured by rivets to said lower wing, with rivet heads sunk below an outer surface of said wing.

6. A slide fastener slider comprising a slider body including an upper wing and a lower wing jointed together at their one ends by a connecting neck and having respective inwardly directed lateral flanges, and a thermal insulating backing substantially coextensive with and secured to said lower wing, said backing having a hook at one end engageable in a recess formed in said neck and a hook at the opposite end engageable in a recess formed in a rear end of said upper wing, said backing having a web surrounded by a continuous inwardly directed peripheral flange, and said web defining with the outer surface of said lower wing an air accommodating pocket.

7. A slide fastener slider according to claim 6 wherein said hooks in said backing are interchanged with said recesses in said lower wing.

* * * * *